US006981711B2

(12) United States Patent
Seta

(10) Patent No.: US 6,981,711 B2
(45) Date of Patent: Jan. 3, 2006

(54) TELESCOPING SKATEBOARD

(76) Inventor: Roy Seta, 107 Duane St., #B, San Jose, CA (US) 95110

( * ) Notice: Subject to any disclaimer, the term of this patent is extended or adjusted under 35 U.S.C. 154(b) by 45 days.

(21) Appl. No.: 10/730,588

(22) Filed: Dec. 8, 2003

(65) Prior Publication Data

US 2005/0121872 A1 Jun. 9, 2005

(51) Int. Cl.
*B62M 1/00* (2006.01)

(52) U.S. Cl. ..... 280/87.05; 280/87.041; 280/87.042; 280/7.13

(58) Field of Classification Search ..... 280/7.13, 280/841, 11.19, 11.223, 11.224, 11.231, 11.233, 280/11.27, 11.31, 87.01, 87.021, 87.041, 280/87.042
See application file for complete search history.

(56) References Cited

U.S. PATENT DOCUMENTS

| | | | | | |
|---|---|---|---|---|---|
| 622,815 | A | * | 4/1899 | Lindsley | 280/11.233 |
| 1,728,063 | A | * | 9/1929 | James | 280/11.233 |
| 3,771,811 | A | * | 11/1973 | Bueno | 280/87.042 |
| D233,803 | S | * | 11/1974 | Cummings | D24/143 |
| 4,076,265 | A | * | 2/1978 | Eash, II | 280/87.042 |
| 4,168,076 | A | * | 9/1979 | Johnson | 280/11.216 |
| 4,195,857 | A | * | 4/1980 | Hechinger | 280/87.042 |
| 4,394,028 | A | * | 7/1983 | Wheelwright | 280/11.19 |
| 4,445,699 | A | * | 5/1984 | Darasko | 280/87.041 |
| 4,458,907 | A | | 7/1984 | Meredith | 280/87.04 A |
| 4,541,643 | A | * | 9/1985 | Pavincic | 280/11.201 |
| 4,709,937 | A | * | 12/1987 | Lin et al. | 280/11.209 |
| 4,991,861 | A | * | 2/1991 | Carn et al. | 280/87.042 |
| 5,062,630 | A | * | 11/1991 | Nelson | 482/34 |
| 5,090,716 | A | * | 2/1992 | Borden | 280/87.042 |
| 5,398,950 | A | * | 3/1995 | Tkaczyk | 280/11.233 |
| 5,484,149 | A | * | 1/1996 | Lee | 280/11.26 |
| 5,505,474 | A | * | 4/1996 | Yeh | 280/87.042 |
| 5,707,068 | A | | 1/1998 | Bradfield | 280/87.042 |
| 5,769,438 | A | | 6/1998 | Svetlov | 280/87.041 |
| 5,826,895 | A | | 10/1998 | Bradfield | 280/87.042 |
| 5,860,657 | A | * | 1/1999 | Kroher | 280/11.223 |
| 5,971,406 | A | | 10/1999 | Lyman | 280/11.22 |
| 6,116,620 | A | * | 9/2000 | Gabrielli | 280/11.19 |
| 6,131,931 | A | | 10/2000 | Globerson et al. | 280/87.042 |
| 6,338,494 | B1 | * | 1/2002 | Killian | 280/87.042 |
| 6,375,198 | B1 | * | 4/2002 | Caeran et al. | 280/11.221 |
| 6,398,229 | B1 | * | 6/2002 | Saylor | 280/11.19 |
| D472,596 | S | | 4/2003 | Schnuckle et al. | D21/765 |
| D473,905 | S | | 4/2003 | Schnuckle et al. | D21/765 |
| 6,676,138 | B1 | * | 1/2004 | Rosso | 280/11.221 |
| D493,858 | S | * | 8/2004 | Green et al. | D21/763 |
| 2003/0127816 | A1 | | 7/2003 | Schnuckle et al. | 280/87.042 |

* cited by examiner

*Primary Examiner*—Christopher P. Ellis
*Assistant Examiner*—Kelly E Campbell
(74) *Attorney, Agent, or Firm*—Schneck & Schneck; Thomas Schneck; David M. Schneck

(57) ABSTRACT

A telescoping skateboard having a telescoping member, a toe platform on one end of the telescoping member and a heel platform at the other end of the telescoping member. A front wheel assembly is attached to the front of the telescoping member and a rear wheel assembly is affixed to the other end of the telescoping member. A microboard extends from one side of the skateboard and may be movable to either side of the skateboard or over the heel platform when retracted.

12 Claims, 4 Drawing Sheets

TELESCOPING SKATEBOARD

TECHNICAL FIELD

The present invention relates to skateboards and more specifically to portable skateboards.

BACKGROUND OF THE INVENTION

Skateboard riding has become an increasing popular pastime, especially among school age children. Such an activity provides a means of transportation and outdoor exercise.

Conventional skateboards consist of an elongated deck (as made of wood or fiberglass) with two truck and wheel assemblies mounted under the deck roughly shoulder width apart. The wheels are typically polyurethane and are mounted on an axle of a pivoting truck assembly. The truck includes a resilient ring that allows the truck to pivot about its connection with the deck, allowing the skateboard to tilt slightly over the wheels. This tilting causes radial displacement of the axles, allowing the board to turn. Decks range in width from 6 to 12 inches and from 2 to 3 feet in length. Much longer oversized boards, known as long-boards, are also used.

The size and weight of skateboards presents certain disadvantages. When not in use the boards most often are hand carried. In public commercial establishments, such as convenience stores and movie theaters, skateboards present difficulties for their user. The skateboard presents a hazard of knocking items off surfaces or bumping customers if the user is not careful. In addition if the user places the skateboard in an isle or other walkway, the board is a danger to other customers. In addition, the board is difficult to transport and store when not in use. For example on busses or trains, the user must ride carrying the skateboard or with the skateboard in the user's lap. Conventional skateboards are quite sizable and do not fit in a standard backpack and are difficult to fit into a school locker.

A number of different attempts have been made to provide a skateboard that is more portable. U.S. Pat. No. 5,505,474 to Yeh discloses a folding skateboard having a plurality of frame bars connected by a series of links. At a front and rear end of the frame bars are rotatable connectors onto which a wheel assembly is mounted. The rider stands on a platform mounted on the connector over the wheel assembly. A number of pins are used to hold the frame bars in position. The pins may be removed to fold the bars of the skateboard.

U.S. Pat. No. 5,769,438 discloses a skateboard having a front, middle and rear sections. A hinge joins the front section to the middle section and a second hinge joins the middle section to the rear section. Wheel assemblies are attached to the front and rear sections of the skateboard. The two hinges allow folding of the board, making the board more compact.

U.S. Pat. No. 5,971,406 discloses a foot supporting skate device. This device includes a skate, such as an inline skate, worn on a first foot. The skate includes a platform extending from the rear of the skate and having an additional wheel. A rider may position a second foot on this platform so that the skate may be used alone. The second foot could be used to propel the rider, as would be done with a skateboard.

U.S. Pat. No. 6,131,931 to Globerson et al. discloses a folding skateboard having front and back wheel and truck assemblies. The deck of the skateboard includes three sections. A first section is about half the length the board, and middle section having a width that is about the height of the wheel and truck assembly and the third section making up the remaining length of the skateboard. The sections are connected by hinges such that the board may be folded. In the folded position, the wheels are aligned side by side. This allows the board to compact to a size about half the size of the extended board, and one deck thickness greater in depth than an assembled board. Clips or fastening rods may be used to secure the board when it is in the open position.

U.S. Pat. App. Pub. 2003/0127816 A1 to Schnuckle at al. discloses a foldable skateboard. This device includes a pair of front wheels on an articulated strut attached to a central platform. A pair of rear wheels on a hinged support is also attached to the central platform. Over the back wheels is a small platform. The front and back wheels each may be folded over the central platform. A user would ride this device with one foot on the central platform. The other foot either provides the driving force for the skateboard or rests on the rear platform. The rear platform is directly behind the central platform requiring a user to position both feet along the longitudinal median of the device. This is also true of the rollerskate of U.S. Pat. No. 5,971,406. The central platform is at least as large as the rider's foot. The foot platform is in the same plane as the front and rear wheel axles.

To ride a conventional skateboard, a rider paces a front foot on the board at an angle (such as a 45 degree angle) relative to the longitudinal median axis of the board. Thus the toe area of the rider's foot is closer to one side of the board and the rider's heel is closer to the other side of the board. The second foot of the rider is used to propel the board forward. The "pumping" action of the foot provides a forward force to roll the skateboard forward. When the board coasts, the pumping foot is placed on the rear of the board, also at a angle similar to the angle of the front foot. To steer the board, toe or heel pressure is exerted to one side of the board. This angles the wheel axles on the truck, angling the wheels and turning the skateboard.

In the prior art, the foldable skateboards disclosed are all, when folded into the compact size, at least the size of the rider's foot, and in most cases are substantially larger. Most of the foldable or collapsible skateboards require an unconventional foot position. For example, U.S. Pat. No. 5,941,406 and U.S. Pat. Appln. Pub. No. 2003/0127816 A1 require a foot position in which the planted foot faces forward and the pumping foot is directly behind the planted foot when resting on the device. This is not the natural foot position when riding a conventional skateboard, and this foot position negatively impacts rider comfort and skateboard maneuver ability.

SUMMARY OF THE INVENTION

The present invention is a telescoping skateboard including a front wheel assembly and a rear wheel assembly joined by a telescoping member. The telescoping member may include a spring joining the front wheel assembly to the rear wheel assembly. Mounted at the front of the board is a toe platform and mounted at the rear of the device is a heel platform. Also mounted at the rear of the device wheel is a microboard. The microboard extends to the side of the skateboard.

A rider may position one foot on the toe platform and heel platform, and rest the second foot on the microboard to coast when the second foot is not being used to move the board forward. The toe platform may be angled such that the rider's toe does not point straight forward. The heel platform may be raised in respect to the toe platform. A toe and heel strap may be included to secure one foot of a rider to the board. The other foot may be used to push the device.

Embodiments of the present device enhance the compacting features of the devices. The front wheel assembly may be a single wheel mounted on a retractable strut. The microboard may pivot into a folded position over the toe platform and heel platform. When the microboard and front wheel are folded into the compact position and the telescoping is also frame retracted, the compact skateboard has a top area not much larger than a CD jewel case.

BEST MODE FOR CARRYING OUT THE INVENTION

Figure 1:
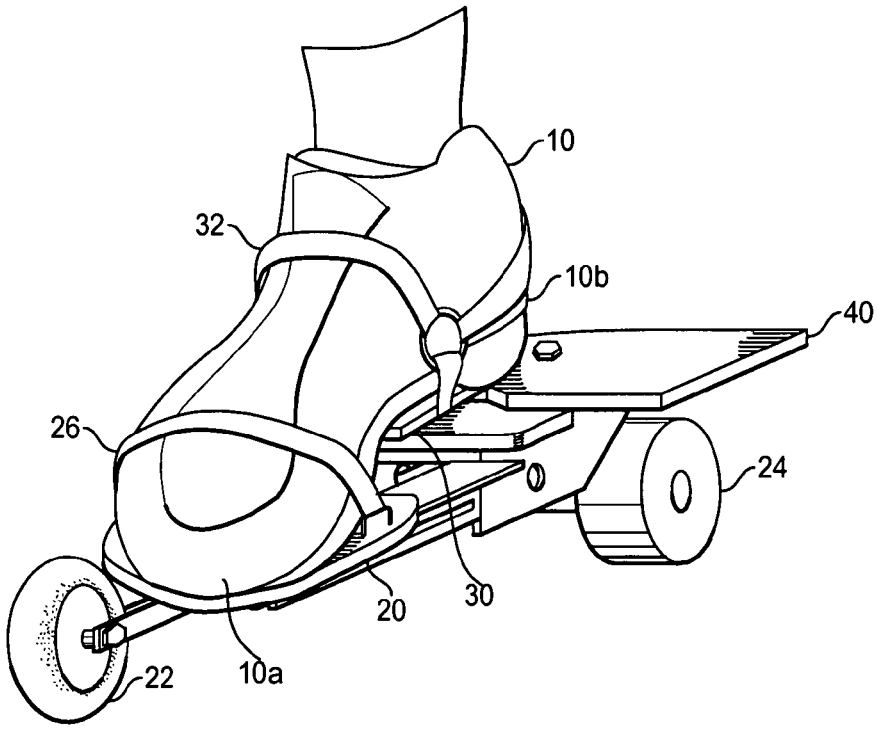
FIG. 1 is a perspective view of the telescoping skateboard of the present invention with a user's foot strapped onto the skateboard.

Aspects of the present invention are illustrated in the following examples. With reference to FIG. 1 a perspective view of a user's foot 10 on a telescoping skateboard in accord with the present invention is illustrated. The toe area of the user's foot 10*a* is held on toe platform 20. The toe may be secured with toe strap 26 extending from toe platform 20. As illustrated, toe platform 20 is angled such that the rider's foot 10 is not facing straightforward but angled relative to the medium longitudinal access of the skateboard. This mimics the natural positioning of a rider's foot on a skateboard. The heel 10*b*, the user's foot 10 rest on heel platform 30. Heel platform 30 may be elevated relative to toe platform 20. As illustrated, toe platform is below the level of the top of front wheel 22 while heel position is above back wheel 24. Strap 32 extends across the top of the user's foot and behind the user's foot. Strap 32 is affixed to heel platform 30. Straps 26 and 32 securely attach a rider's foot to the skateboard. The use of such straps allows a rollerskate or rollerblade type attachment of one foot to the skateboard. This is achieved without any of the bulk of a rollerskate or rollerblade boot. Such an attachment provides a skate-like control of the device. Microboard 40 extends from the side of the rear section of the skateboard. Front wheel 22 extends from the front of the skateboard and rear wheel 24 is positioned at the back of the skateboard. The heel platform 30 and microboard 40 are positioned over rear wheel 24.

Figure 2:
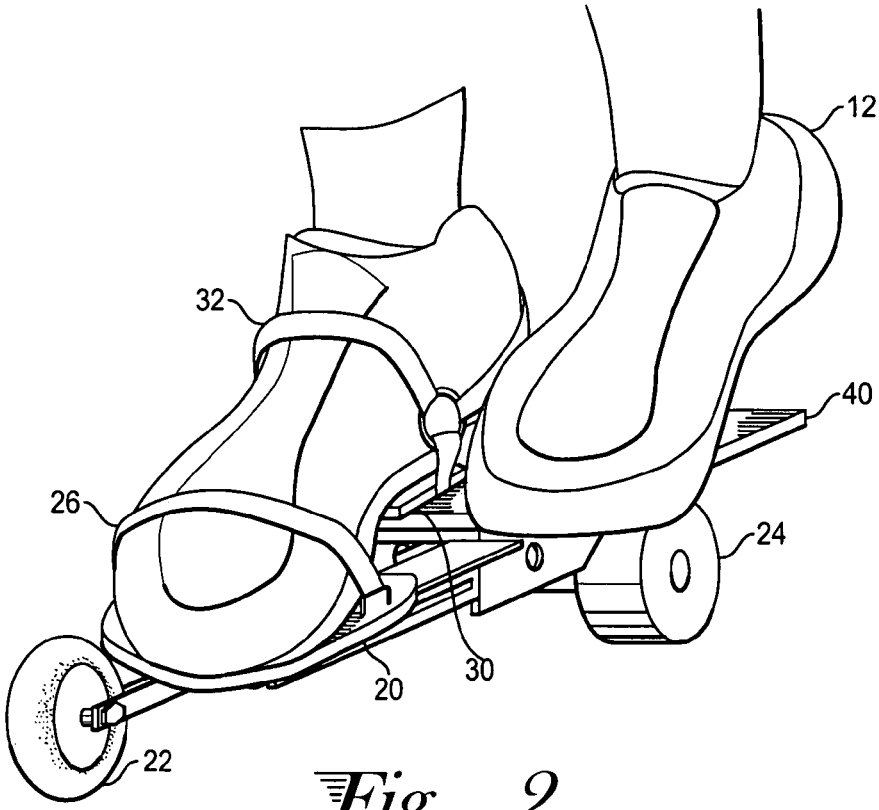
FIG. 2 is the perspective view of FIG. 1 with a user's second foot positioned on the microboard.

FIG. 2 illustrates the use of device with both feet positioned on the device. As before foot 10 rests with a toe on toe platform 20 and a heel on heel platform 30 with the foot secured at the toe and heel regions by straps 26 and 32, respectively. Front wheel 22 and rear wheel 24 contact the ground allowing the device to be pushed forward by user's second foot 12. As pictured, user's second foot 12 rests on microboard 40. This is the position that the rider would assume as the skateboard coasts.

Figure 3:
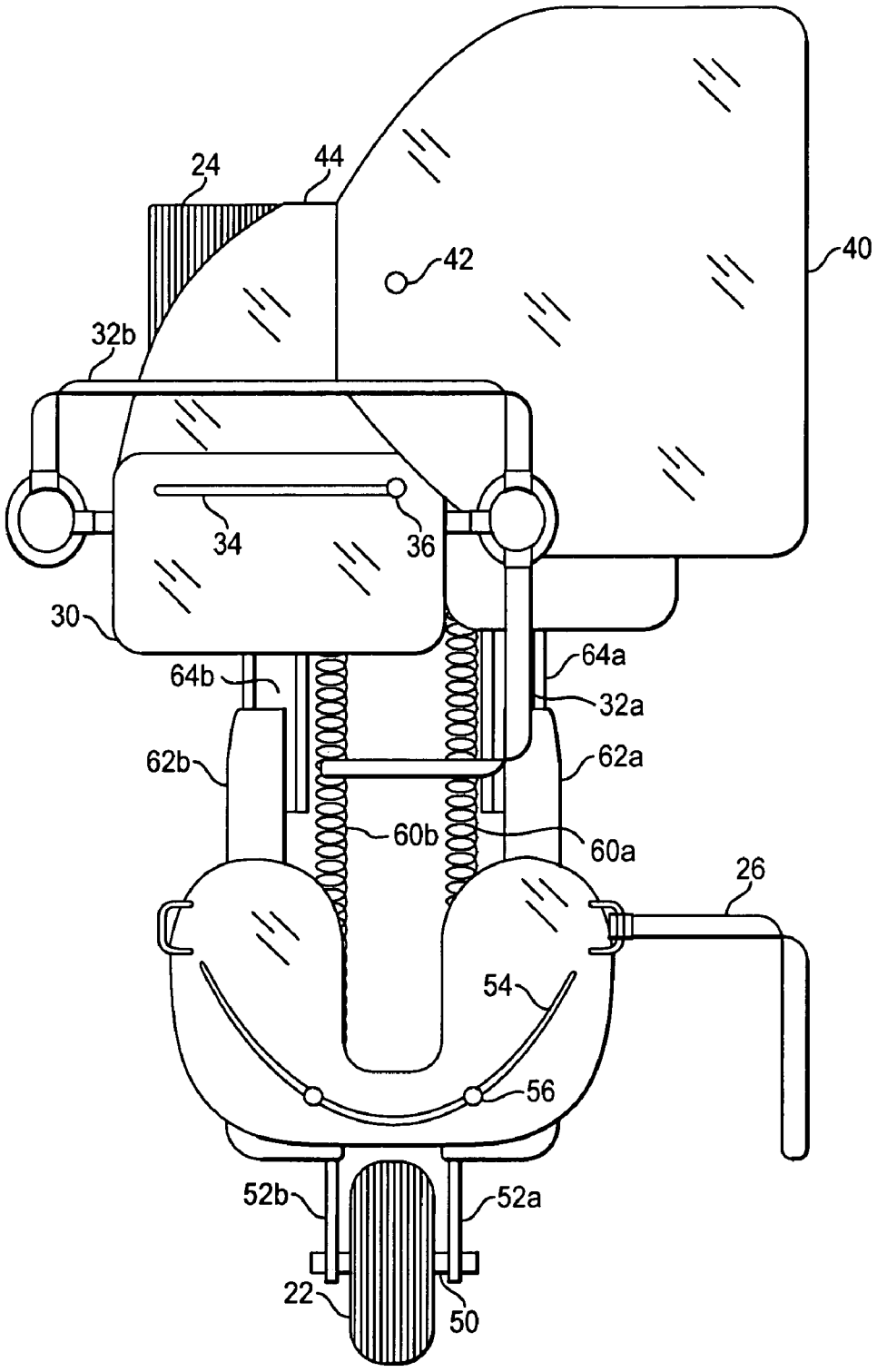
FIG. 3 is a top view of the telescoping skateboard of FIG. 1.

With reference to FIG. 3, the front wheel 22 is mounted on bolt 50 (that acts as an axle) held on struts 52*a*, 52*b*. Behind the front wheel 22 on the telescoping guides 62*a*, 62*b* is mounted toe platform 20. Toe platform 20 is attached to the top of guides 62*a*, 62*b* by bolts 56 which are secured through groove 54 on toe platform 20. Groove 54 allows the toe platform 20 to be rotated such that it is angled to either side of the telescoping skateboard. This allows the device to be used for either the left or right foot of the user. Guides 62*a* and 62*b* are slidably mounted in track 64*a*, 64*b* respectively. Springs 60*a*, 60*b* are attached at the front of the device at one end of the springs in the rear of the device at the other end of the spring such that a spring bias retracts guides 62*a*, 62*b* along tracks 64*a*, 64*b* drawing together the back and front ends of the device.

At the rear of the device mounted over rear wheel 24 is a base board 44. Mounted onto base board 44 is heel platform 30. A bolt 36 extending through groove 34 allows variable positioning of the heel platform 30. A microboard 40 is attached by bolt 42 base board 44. If a user wishes to switch a device from a left to right foot the toe positioning of toe platform 20 may be reversed by angling the toe platform towards the opposite side of the skateboard. The location of heel position determined by heel platform 30 could also be repositioned to be aligned with toe platform 20. The attachment of microboard 40 by bolt 42 allows microboard 40 to be repositioned such that it extends from the opposite side of the skateboard. This effectively allows the device to be worn on either the left or right foot. Strap 26 on toe platform 20 may be fastened across the user's toe and strap 32 behind the heel and across the top of a shoe such that length 32*b* of strap 32 extends behind the heel and length 32*a* of strap 32 extends across the top of a user's shoe.

Figure 4:
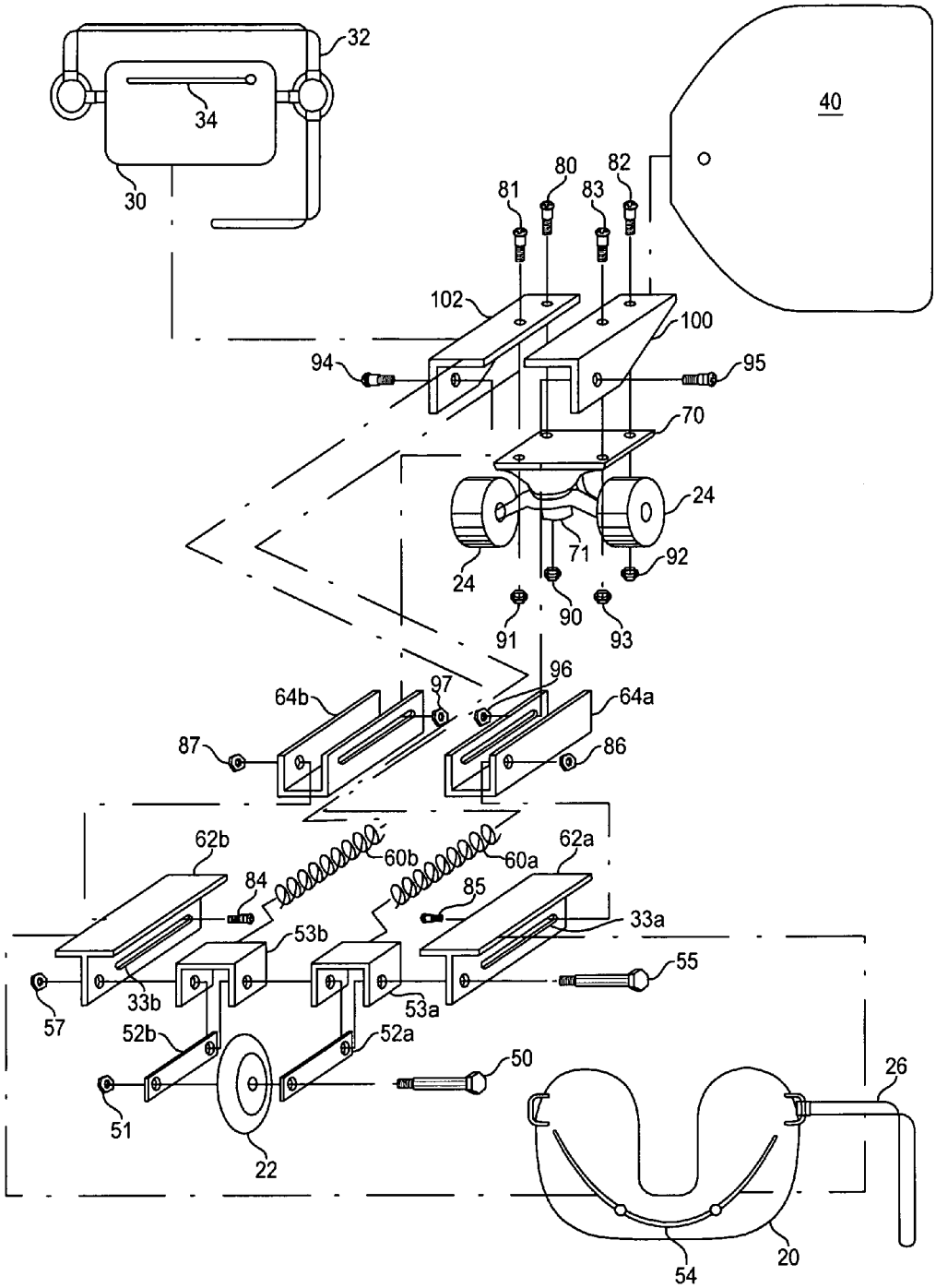
FIG. 4 is an exploded view of the telescoping skateboard of FIG. 3.

The specific assembly of one example of the device is shown in FIG. 4. The wheel assembly includes a bolt 50 which extends through strut 52*a* through the center of the wheel 22 through strut 52*b* and is secured by nut 51. Bolt 50 then acts as an axle upon which wheel 22 may turn. Struts 52*a*, 52*b* are mounted within brackets 53*a*, 53*b* respectively. A bolt 55 extends through guide 62*a* through a hole in a first side of bracket 53*a* through a hole in a back end of strut 52*a* through a hole in the other side of bracket 53*a*. The bolt continues in a similar manner passing through a hole in one side of bracket 53*b* through a hole in strut 52*b* through a hole in the other side of bracket 53*b* and finally through a hole in one end of guide 62*b* where the end of bolt 55 is secured nut 57. Nut 57 is tightened to hold all of the pieces frictionally together. The spacings of strut 52*b*, 52*a* (secured at a front end of each strut by bolt 50 and nut 51) spaces the struts such that they are spaced at a width about as wide as the width of brackets 53*a* and 53*b*. This configuration allows the struts to retract by rotating on bolt 55 allowing the wheel and struts to retract back.

The telescoping aspect of the skateboard is achieved by guides 62*a*, 62*b* which slide in tracks 64*a*, 64*b*. Guide 62*a*, 62*b* are affixed by bolts 85, 84 respectively which are secured through a hole in tracks 64*a*, 64*b* and secured by nuts 86, 87. When nuts 86, 87 are secured onto bolts 85, 84 the guides 62*a*, 62*b* may slide along the length of groove 33*a*, 33*b*.

In a similar manner, tracks 64*a*, 64*b* may slide relative to brackets 100, 102. Track 64*a* is attached to bracket 100 by bolt 95 which extends through track 31*a* and is secured on the other side by nut 96. Similarly, track 64*b* is attached by nut 94 which extends through groove 31*b* and is secured by nut 97. In this way tracks 64*a*, 64*b* may slide freely on the bolts 95, 94 respectively.

Springs 60*a*, 60*b* are attached at a first end to either brackets 53*a*, 53*b* or to a front end of rails 62*a*, 62*b*. Springs 60*a*, 60*b* are attached at a first end spring and to brackets 100, 102 respectively and at a second spring end to a front portion of guides 62*a*, 62*b*. This attachment of the springs provides a force retracting the guides 62*a*, 62*b* towards the back of the telescoping skateboard. This attachment allows the guides 62*a*, 62*b* to retract in the tracks 64*a*, 64*b*. The tracks 64*a*, 64*b* retract against the sides of the brackets 100, 102. In this way the device becomes much more compact. The guides, tracks, and brackets form a telescoping member (or telescoping frame) onto which the platforms for a rider's toe end heel and the microboard are mounted.

Brackets 100, 102 are affixed to truck 70 by bolts 80, 81, 82, 83 which extend through the truck and are respectively secured by nuts 90, 91, 92, and 93. Wheels 24 are mounted on truck 70. A resilient ring 71 allows the axle mounted on truck 70 to pivot allowing the skateboard to turn.

Mounted over guides 62*a*, 62*b* is toe platform 20 secured by bolts extending through groove 64. The toe strap 26 is attached to one side of the toe platform. The attachment of toe platform 20 by bolts extending through groove 54 allows the toe platform 20 to be angled to the side of the portable skateboard. This angling allows more natural foot position. This angling also allows the portable skateboard to be used with either of the rider's feet. If a rider decides to switch feet the toe platform can be angled to the opposite side of the portable skateboard. The heel platform 30 is affixed to brackets 100, 102 by bolts extending through groove 34. Heel strap 32 is joined to the sides of heel platform 30.

Microboard 40 extends from the side of bracket 100 affixed by a bolt extending through microboard 40. Both heel platform 30 and microboard 40 may be moved to allow user to use the device on either foot. Heel platform may be positioned by sliding the platform along groove 34 such that when the rider's toe is angled on the toe platform the heel may comfortably rest on the heel platform. The microboard 40 should be positioned such that it extends from the side of the telescoping skateboard of the foot that is not affixed on the toe and heel platform. The angle of the top platform will be the same side of the skateboard.

Figure 5:
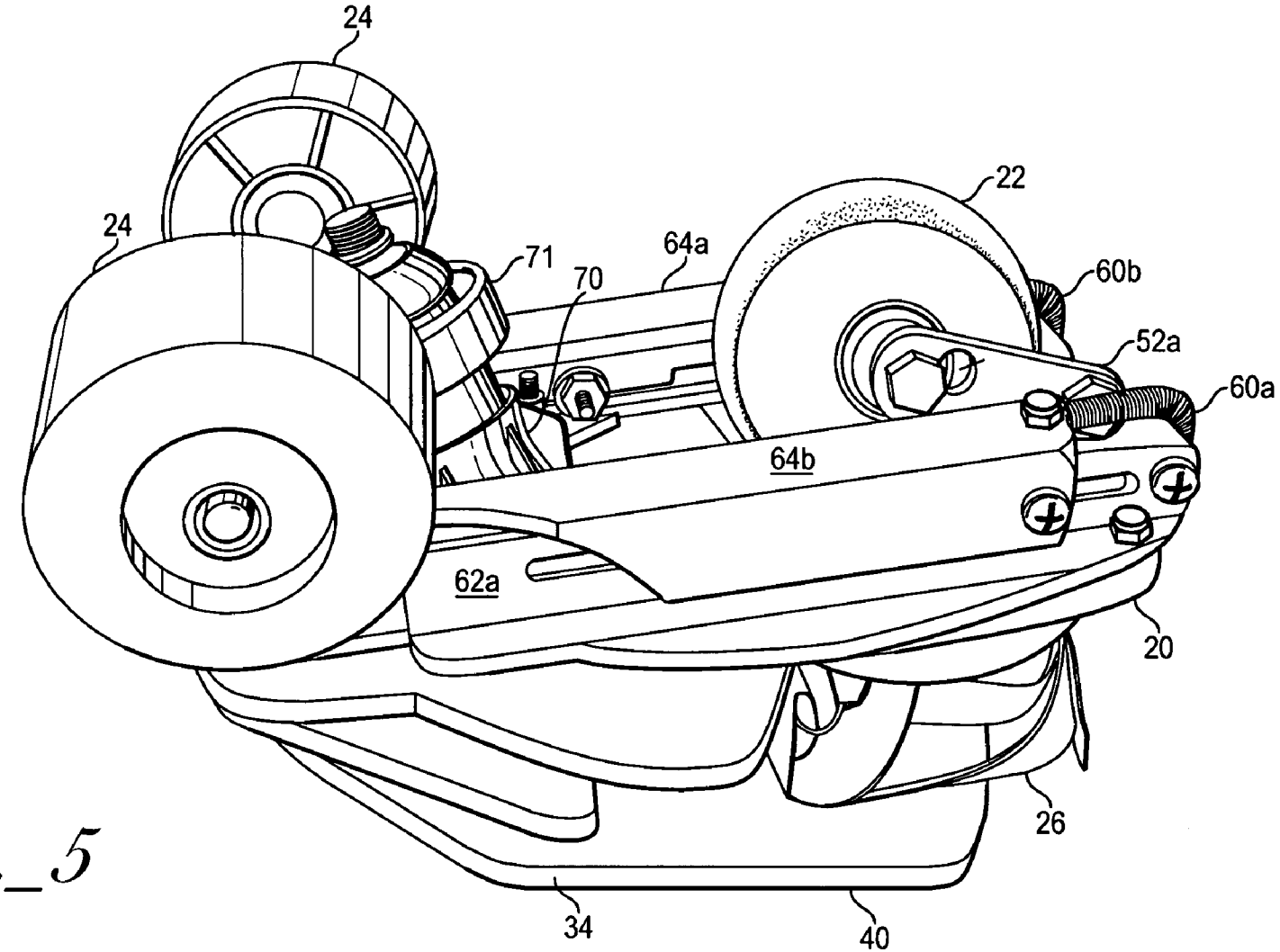
FIG. 5 is a side perspective view of the skateboard of FIG. 3 with the skateboard fully collapsed.

The fully compacted telescoping skateboard is shown in FIG. 5. Front wheel 22 is retracted back on strut 52*a*. Tracks 64*a*, 64*b* are fully retracted into the respective 62*a* (and 62*b* not shown in FIG. 5) such that toe platform 20 is partially over heel platform 34 and microboard 40 is over part of both of these platforms. Toe strap 26 is held between microboard 40 and toe platform 20. Attached at the back of the telescoping skateboard is truck 70 having wheels 24 mounted with a resilient ring 71 allowing the rear wheels to turn. The total depth of the device is about the same as a non-retracted telescoping skateboard. The length of the device when compact is generally less than the size of a user's foot. This is achieved by the telescoping frame which divides the deck into a toe platform and a heel platform such that the toe platform may be retracted over part of the heel platform when the device is in the compact form shown in FIG. 5. The resulting compact skateboard may easily be stored in a backpack or school locker and is small enough so that it could be held in large pockets on jacket or cargo pants.

The rear skateboard truck and wheel assembly provides maneuvering capabilities which should be similar to the maneuvering of a conventional skateboard. The use of a single front inline wheel eliminates the bulk of using both front and rear truck and wheel assemblies. This front wheel is disposed on struts which fold back and neatly fit within the telescoping frame. However, as an alternative dual front wheels could be used if desired. The wheels may be commercially available polyurethane wheels with internal bearings as used in skateboards or in-line rollerskates.

Attaching one foot to the board eliminates the need for a expansive deck to allow proper foot position. The attachment of foot also compensates for maneuverability lost through the single wheel/truck assembly. As noted throughout, the skateboard can be attached to either foot by pivoting the toe platform to the opposite side of the skateboard, sliding the heel platform to the new heel position and the pivoting microboard to the opposite side of the skateboard. The angled position of the foot allows a similar heel-toe pressure to turn the wheels mounted on the truck. This should provide a maneuverability similar to that of conventional skateboard.

Unlike conventional rollerskates (such as in-line rollerskates) only a single telescoping skateboard is required. A rollerskate in contrast requires a skate for each foot. The height of the telescoping skateboard is similar to the height of a conventional skateboard. This contrasts with roller, which require a bulky boot which is more difficult to transport in a backpack or store in a school locker.

The present invention also has advantages over conventional skateboards. It is much more portable and may be easily stored. There is low risk of bringing this small, compact device into theater or a convenience store. The unique features of the telescoping skateboard allow foot position similar to that of a conventional skateboard. Because one foot may be affixed to the board, the ability to maneuver the telescoping skateboard of the present invention is enhanced. The front line in-line wheel eliminates the bulk associated with a front skateboard truck assembly. The telescoping frame of the present skateboard reduces the bulk of the device and has greater ability to retract a small size than even other retractable foldable skateboards. The telescoping feature also allows the frame to automatically adjust to different shoe sizes of different riders. If springs are used, the rider merely may fold the microboard into position, strap the device onto the rider's planted foot and begin to ride the skateboard.

The foot position allowed by the present invention is the natural foot positioning of a foot on a skateboard. The one alteration compared to the conventional skateboard is the heel position is slightly raised. In the illustrative embodiment the toe is positioned on the toe platform just above the axle level of the front wheel while the heel is raised above the top of the rear wheel. This positioning increases the front/back stability and prevents the weight of the rider from shifting too far to the rear. The positioning of the toe angled to the side decreases the strain on the shin. This also allows the rider to turn the telescoping skateboard as the rider would a conventional skateboard, i.e. shifting weight between the toe and heel portion. Such a device would be much more comfortable to ride compared to a in-line skate having a rear platform requiring both feet to be longitudinally oriented along the longitudinal median line of the rollerskate device.

The toe platform, heel platform, and microboard include grip tape decals or both as is typical on conventional skateboards. They may be made of wood (e.g. plywood) or fiberglass like a conventional skateboard. The illustrated telescoping device using a guide and track system is one telescoping embodiment. It is also possible to use telescoping concentric pipe segments with flared ends. The spring of the present invention provides an advantageous means for retracting the device to the retracted form. However, if no spring is used the telescoping device can merely slide to a position and be affixed in that position by either tightening the nut and bolt combinations such that fictional sliding no longer occurs or through the use of a locking latch.

I claim:

1. A telescoping skateboard comprising:

a rear wheel assembly;

a heel platform mounted over the rear wheel assembly;

a retractable front wheel assembly;

a telescoping frame joining said front wheel assembly and said rear wheel assembly;

a toe platform mounted on the telescoping frame; and a microboard mounted over the rear wheel assembly such that it may swivel into a position over the heel platform or to a position such that said microboard may project from either side of the skateboard, wherein the toe platform mounted on the telescoping frame can retract to a folded position in which the toe platform is at least partially under the heel platform and the microboard is over the heel platform.

2. The telescoping skateboard of claim 1 wherein said front wheel assembly is a single wheel mounted on a pair of struts.

3. The telescoping skateboard of claim 1, wherein said toe platform includes a side angling means for toe positioning.

4. The telescoping skateboard of claim 1, further including a toe strap.

5. The telescoping skateboard of claim 4, further including a heel strap.

6. The telescoping skateboard of claim 1, wherein in said telescoping frame includes a spring linking the front wheel assembly and the rear wheel assembly.

7. The telescoping skateboard of claim 1, wherein said heel platform is raised in respect to said toe platform.

8. A telescoping skateboard comprising:

a rear wheel assembly;

a heel platform mounted over the rear wheel assembly;

a retractable single wheel front wheel assembly;

a toe platform;

a telescoping frame joining said front wheel assembly and said rear wheel assembly wherein said toe platform is mounted to one end of the telescoping frame;

a spring mounted such that the spring extends along a length of the telescoping frame and provides a force retracting said front wheel assembly and said rear wheel assembly toward each other; and a side facing microboard mounted over the rear wheel assembly such that it may swivel into a position over the heel platform, wherein the toe platform mounted on the telescoping frame can retract to a folded position in which the toe platform is at least partially under the heel platform and the microboard is substantially over the heel platform.

9. The telescoping skateboard of claim 8, wherein said toe platform includes a side angling means for toe positioning.

10. The telescoping skateboard of claim 8, further including a toe strap.

11. The telescoping skateboard of claim 8, further including a heel strap.

12. The telescoping skateboard of claim 8, wherein said heel platform is raised in respect to said toe platform.

* * * * *